US010344558B2

(12) United States Patent
Gao et al.

(10) Patent No.: US 10,344,558 B2
(45) Date of Patent: Jul. 9, 2019

(54) SYSTEMS AND METHOD FOR REVERSE CEMENTING

(71) Applicant: Halliburton Energy Services, Inc., Houston, TX (US)

(72) Inventors: Bo Gao, Spring, TX (US); Yuzhu Hu, Spring, TX (US); John P. Singh, Kingwood, TX (US); Walmy Cuello Jimenez, Al Khobar (SA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/751,931

(22) PCT Filed: Sep. 8, 2015

(86) PCT No.: PCT/US2015/048941
§ 371 (c)(1),
(2) Date: Feb. 12, 2018

(87) PCT Pub. No.: WO2017/044075
PCT Pub. Date: Mar. 16, 2017

(65) Prior Publication Data

US 2018/0238139 A1 Aug. 23, 2018

(51) Int. Cl.

| | |
|---|---|
| ***E21B 33/14*** | (2006.01) |
| ***E21B 49/08*** | (2006.01) |
| ***E21B 34/04*** | (2006.01) |
| ***E21B 43/12*** | (2006.01) |
| ***E21B 47/00*** | (2012.01) |
| ***E21B 34/08*** | (2006.01) |
| *E21B 34/00* | (2006.01) |

(52) U.S. Cl.
CPC ..... *E21B 33/14* (2013.01); *E21B 34/08* (2013.01); *E21B 47/0005* (2013.01); *E21B 2034/002* (2013.01); *E21B 2034/005* (2013.01)

(58) Field of Classification Search
CPC ..... E21B 49/08; E21B 49/081; E21B 49/088; E21B 33/13; E21B 33/14; E21B 2034/002; E21B 2034/005; E21B 34/08; E21B 43/121; E21B 47/0005
See application file for complete search history.

(56) References Cited

U.S. PATENT DOCUMENTS 4,035,023 A * 7/1977 Cockrell ..... E21B 43/121 166/105
5,890,538 A 4/1999 Beirute et al.
(Continued)

OTHER PUBLICATIONS

PCT International Search Report and Written Opinion dated May 23, 2016, issued in corresponding application No. PCT/US2015/048941 filed on Sep. 8, 2015, 16 pgs.

*Primary Examiner* — Zakiya W Bates
(74) *Attorney, Agent, or Firm* — Chamberlain Hrdlicka

(57) ABSTRACT

A material detection and sealing device includes a body comprising a bottom end and a top end, and configured to fit within a casing string. The device includes a valve located within the body configured to open and close an orifice formed through the body. The device also includes a density meter located on or within the body configured to continuously sense the density of a neighboring fluid. The valve is configured to close upon the density meter sensing a certain density condition.

18 Claims, 4 Drawing Sheets

(56) References Cited

U.S. PATENT DOCUMENTS

| | | | | |
|---|---|---|---|---|
| 6,352,110 | B1 * | 3/2002 | Langseth | E21B 49/08 166/264 |
| 2003/0029611 | A1 | 2/2003 | Owens | |
| 2006/0086499 | A1 | 4/2006 | Badalamenti et al. | |
| 2007/0062700 | A1 | 3/2007 | Webb et al. | |
| 2007/0235199 | A1 | 10/2007 | Logiudice et al. | |

* cited by examiner

SYSTEMS AND METHOD FOR REVERSE CEMENTING

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

In cementing operations carried out in oil and gas wells, a hydraulic cement composition is disposed between the walls of the wellbore and the exterior of a pipe string, such as a casing string, that is positioned within the wellbore. The cement composition is permitted to set in the annulus thereby forming an annular sheath of hardened, substantially impermeable cement therein. The cement sheath physically supports and positions the pipe in the wellbore and bonds the pipe to the walls of the wellbore whereby the migration of fluids between zones or formations penetrated by the wellbore is prevented.

One method of cementing involves pumping the cement composition down through the casing and then up through the annulus. In this method, the volume of cement required to fill the annulus must be calculated. Once the calculated volume of cement has been pumped into the casing, a cement plug is placed in the casing. A drilling mud is then pumped behind the cement plug such that the cement is forced into and up the annulus from the far end of the casing string to the surface or other desired depth. When the cement plug reaches a float shoe disposed proximate the far end of the casing, the cement should have filled the entire volume of the annulus. At this point, the cement is allowed to dry in the annulus into the hard, substantially impermeable mass.

This method, however, may not be suitable for all wells, as it requires the cement to be pumped at high pressures, which makes it potentially unsuitable for wells with softer formations or formation prone to fracture. Reverse cementing is an alternative cementing method in which the cement composition is pumped directly into the annulus between the casing string and the wellbore. Using this approach, the pressure required to pump the cement to the far end of the annulus is much lower than that required in conventional cementing operations. After the cement reaches well bottom, the cement will begin to flow up the inside of the casing string unless pumping is stopped. Thus, in reverse cementing operations, it is necessary to identify when the cement begins to enter the far end of the casing such that the cement pumps may be shut off.

BRIEF DESCRIPTION OF THE DRAWINGS

For a detailed description of the embodiments of the invention, reference will now be made to the accompanying drawings in which.

DETAILED DESCRIPTION

The present disclosure provides methods and systems for detecting when an annular space is filled with cement, which signals the completion of a reverse cementing operation or step thereof. The detection is performed through a density sensor placed in a casing that determines the presence of cement inside the casing or at well bottom. Once the density sensor detects presence of cement, an associated valve inside or near the casing is closed, thereby preventing cement from flowing further into the casing. This causes a pressure spike at the cement source, indicating to end the pumping of cement.

Figure 1:
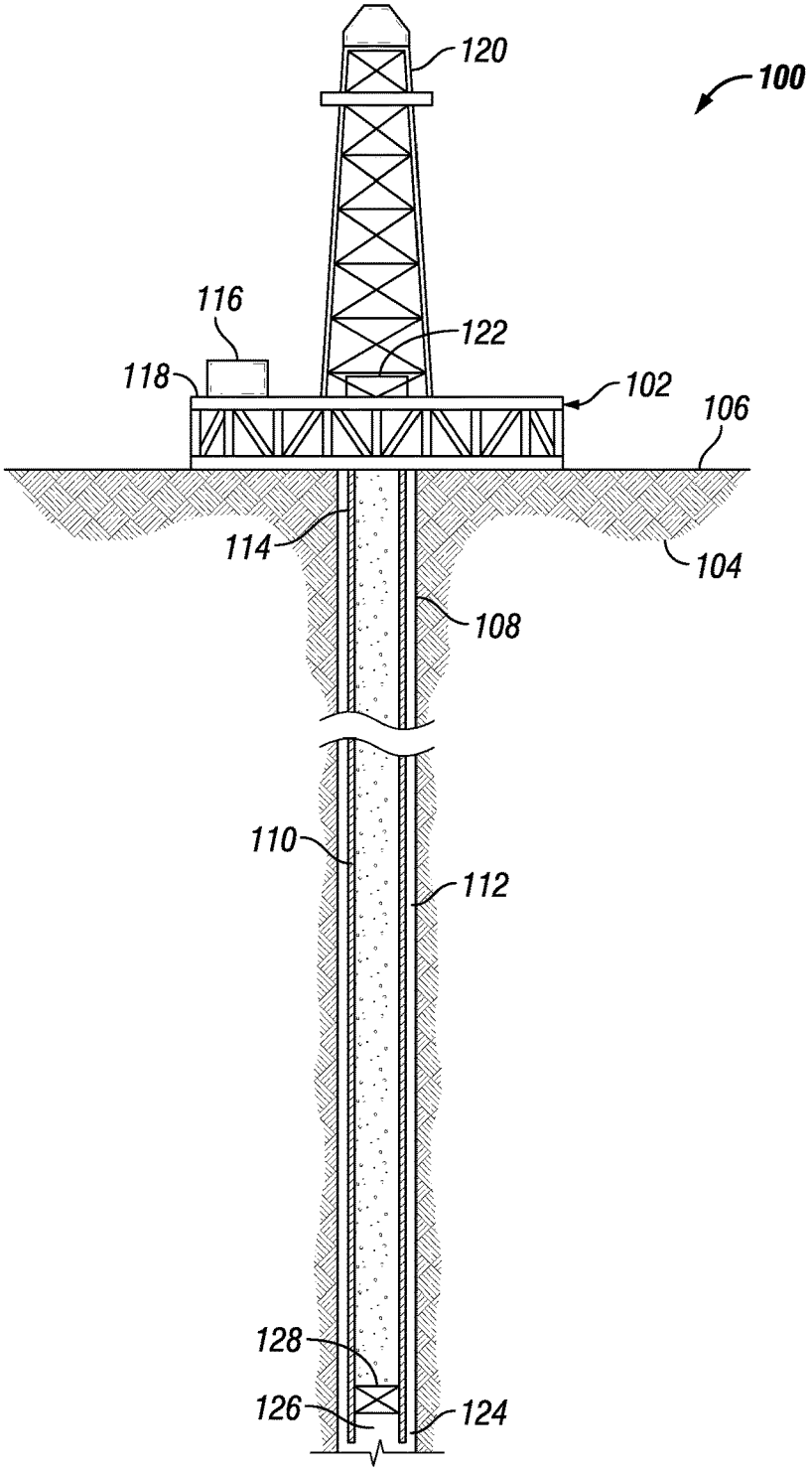
FIG. 1 is a diagram of oil or gas well system undergoing a reverse cementing operation.

Referring to the figures, FIG. 1 illustrates an oil or gas well system 100 undergoing a reverse cementing operation. The system 100 includes a rig 102 centered over a subterranean oil or gas formation 104 located below the earth's surface 106. A wellbore 108 extends through the various earth strata including formation 104. A casing string 110 is located in the wellbore 108 and an annulus 112 is formed between the casing string 110 and the well bore 108. The rig 102 includes a work deck 118 that supports a derrick 120. The derrick 120 supports a hoisting apparatus 122 for raising and lowering pipe strings such as a casing string 110. A pump 116 may be located on the work deck 118 and is capable of pumping a variety of fluids into the well. The pump 116 may include a pressure sensing means that provides a reading of back pressure at the pump discharge.

During a reverse cementing operation, a cementing material is pumped, via the pump 116 located at the surface 106, into the annulus 112 from an upper 114 end of annulus 112 near the surface 106 to a lower end 124 of the annulus 112. The wellbore 108 is typically filled with various fluids such as drilling fluid which may be displaced uphole through the inside of the casing string 110 as the cementing material is pumped downhole through the annulus 112. Drilling fluid has a different density profile than cementing material. Specifically, drilling fluid typically has a lower density than cementing material. Drilling fluid may be any typical drilling fluid such as a water-based or oil-based drilling fluid. The cementing material used may be any typical hydraulic cementitious material including, for example only, those comprising calcium, aluminum, silicon, oxygen and/or sulfur which set and harden by reaction with water. Such hydraulic materials may include Portland cements, pozzolana cements, gypsum cements, high aluminum content cements, silica cements and high alkalinity cements.

In some embodiments, the lower end 124 of the annulus 112 may be directly adjacent to well bottom 126. Thus, the cementing material has a propensity to flow upward and into the casing string 110 when a higher fluid pressure is introduced into the annulus 112 unless pumping of the cementing material is stopped. A sealing device 128 is located in the casing string 110 and configured to detect the presence of cementing material. Upon detection of the cementing material, the sealing device actuates to form a barrier in the casing string 110, thereby preventing the cementing material from rising further into the casing string 110. The sealing device 128 also provides an indication to stop pumping the cementing material at the pump 116. Thereafter, the cementing material is allowed to set in the annulus 112 to form a hard, substantially impermeable mass that physically supports and positions the casing string 110 in wellbore 108 and bonds casing string 110 to the walls of wellbore 108.

Figure 2:
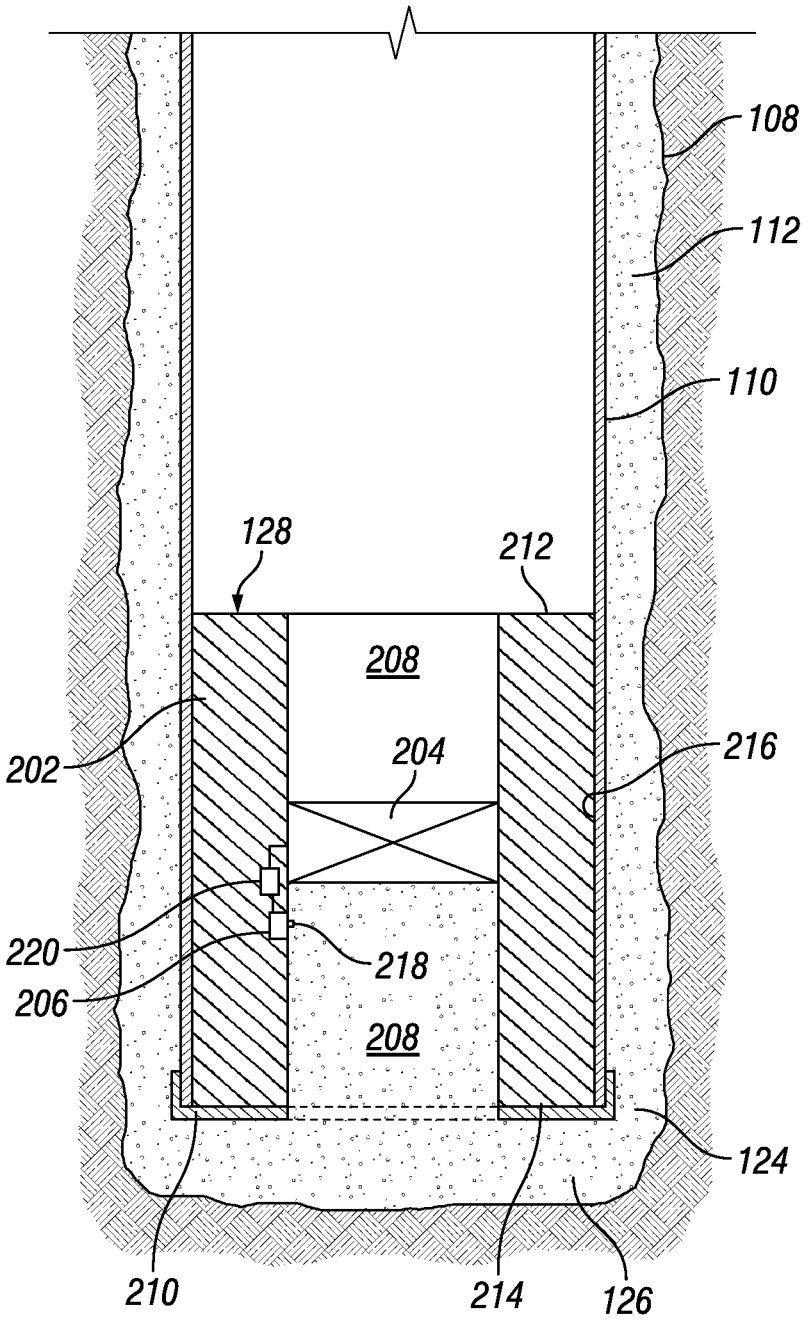
FIG. 2 illustrates a cross-sectional view of reverse cementing detection and sealing device located within a casing string.

FIG. 2 illustrates the sealing device 128 located within the casing string 110. The sealing device 128 may be installed within the casing string 110 before the casing string 110 is lowed downhole. In some embodiments, a float shoe 210 is installed at the distal end of the casing string 110 and the sealing device 128 is located above or partially within the float shoe 210. The device 126 forms a seal against the inside of the casing string 110, effectively plugging the casing string 110 such that fluid cannot flow between the device 126 and the casing string 110. Thus, fluid can only flow upwardly into the casing string 110 through the device 128.

The sealing device 128 may include a body 202 including a top end 212 and a bottom end 214. The body 202 fits within the casing string 110 and essentially acts as a plug in the casing string 110. The body 202 is defined between an outer surface 216 and an inner orifice 208 formed therethrough from the top end 212 to the bottom end 214, the inner orifice providing a flow path through which fluid can flow in and out of the casing string 110. In some embodiments, the body 202 may be fabricated from a plastic or rubber material capable of forming a seal against the casing string 110. The body 202 may be solid or filled with a material such as cement.

The sealing device 128 further includes a valve 204 located within the body 202 configured to open and close the inner orifice 208. The sealing device 128 also includes a density meter 206 located on or within the body 202 and configured to continuously sense the density of a fluid. The valve 204 is configured to close upon the density meter 206 sensing a certain density condition of the fluid. In some embodiments, the density condition is a change in the sensed density of the fluid. In some embodiments, the density meter 206 includes a sensor 218 or probe that extends out of the body 202 and is in fluid communication with the fluid, which may be inside the casing string 110, thereby sensing the density of the fluid inside the casing string 110. Alternatively, the sensor 218 or probe may extend outward through the casing string 110 and into the annulus 112, thereby sensing the density of the fluid in the annulus 112 at the position of the sensor 218. The fluid can be any fluid that is adjacent the sensor 218 of the density meter 206.

As mentioned, the casing string 110 may be filled with an initial fluid such as drilling fluid or other fluid prior to the reverse cementing operation. Thus, initially the fluid is the fluid located near the sealing device 128 prior to the reverse cementing operation. As cement is pumped into the annulus 112 during reverse cementing, the initial fluid gradually gets displaced by the cement, rising through the inner orifice 208 of the device 202 and upwards inside the casing string 110. As the cementing fluid typically has a different density profile than the initial fluid, the density meter 206 will detect a change in the measured density of the fluid, signaling the presence of the cementing material. In some embodiments, the device 128 is placed at any location within the casing string 110 at which the cementing material is to be stopped. In many applications, the sealing device 128 will be placed at the distal end of the casing string 110.

When the density meter 206 detects a change in the measured density of the fluid, the valve 204 is closed, sometimes automatically, thereby preventing cement from flowing further into the well or further up the inside of the casing string 110. When the valve 204 is closed or partially closed, an increase in back pressure will be measured at the pump 116. This indicates the annulus 112 is fully filled with cement and to stop pumping any more cement downhole. In some embodiments, the pump 116 measures the increase in back pressure and automatically stops pumping.

The density meter 206 is coupled to the valve 204 via a processor 220. The processor 220 may be a part of a circuit to which the density meter 206 and the valve 204 are both coupled. In some embodiments, the processor 220 is configured to receive a signal from the density meter 206 indicative of the sensed density. The processor 220, upon receiving a signal from the density meter 206 indicative of a sufficient change in density, sends an actuation signal to the valve 204, thereby closing the valve 204. Alternatively, the density meter 206 and/or processor 220 can be configured to detect when the density of the fluid falls within a certain value window or threshold, which can also indicate presence of cement. The processor 220 can perform any kind of signal processing necessary to determine the presence of cement based on the density meter 206 readings, and transmit any kind of signal necessary to close the valve 204. The processor 220 may be preprogrammed with operating rules and threshold values.

The valve 204 may be a wide variety of valves or valve-like devices that can be actuated to permit and block the flow of fluid. The valve 204 may be a motor driven manual valve such as a flapper valve. The valve 204 may also be a ball valve, a butterfly valve, among others. The example valves 204 discussed herein do not limit the type of valves or valve-like devices suitable for implementing the present disclosure, but rather serve as examples to help illustrate the concept of the present disclosure.

Electronic aspects of the sealing device 128 such as the processor/microcontroller 220, density meter 206, and the valve 204, may be powered by a local power source such as a battery or other power storage device. The battery may be coupled to the processor/microcontroller 220, which passes power to the density meter and valve 204 if needed. The power source can by of other types, such as an onboard or neighboring hydraulic generator. Any type of existing or new power sources can be used to provide power to the electronic aspects of the sealing device 128. In some embodiments, an actuation device, such as a motor, is coupled between the processor/microcontroller 220 and the valve 204, in which the actuation device receives power and signals from the processor/microcontroller 220, and actuates the valve 204 accordingly.

In some embodiments, a data acquisition and processing element may be integrated with the valve 204. The data acquisition and processing element could be programmable to provide better control of the valve 204. For example, the data acquisition and processing element may be configured to delay the closure of the valve 204 to provide shoe track of contamination in the casing string 110. In some embodiments, the data acquisition and processing element can close the valve slowly and reduce the high back pressure.

The device 128 may be configured to detect the presence of a substance other than cement. For example, the device 128 can be configured to detect for the presence of a certain gas, oil, water, drilling fluid, or any other fluid by configuring the settings and operating rules of the density meter or processor 220 with respective values correlated with the densities of such materials.

Figure 3:
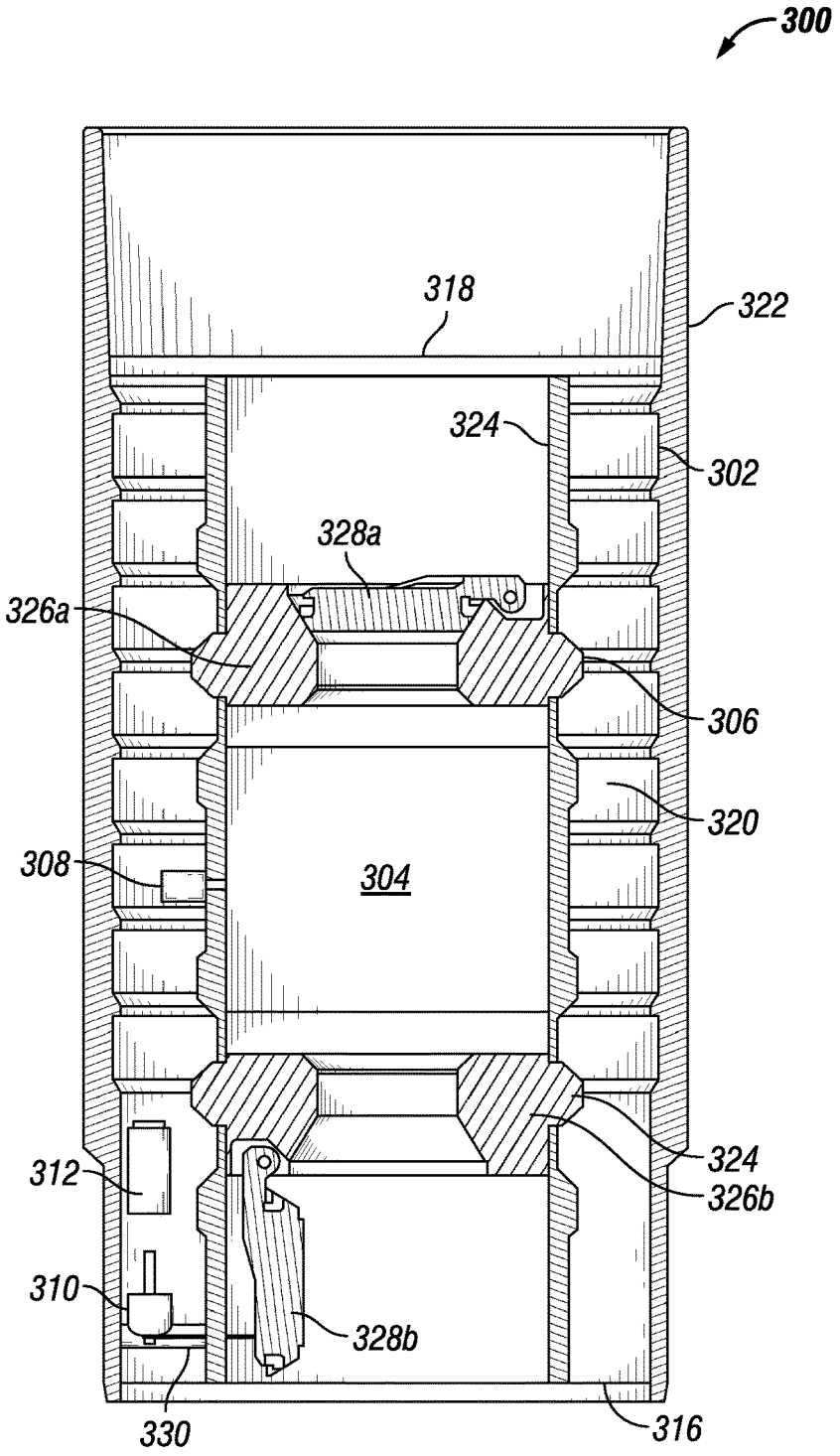
FIG. 3 illustrates a cross-sectional view of one embodiment of a material detection and sealing device.

FIG. 3 illustrates a cross-sectional view of another example material detection and sealing device 300. The device 300 includes a body 302. The body 302 may have a tubular body defined by an outer surface 322 and in inner surface 324 defining an inner orifice 304 traversing the length of the device 300. The body 302 also includes a bottom end 316 and a top end 318. Similar to sealing device 128 of FIG. 2, the device is configured to be coupled with a casing string 110. In some embodiments, the body 302 may be solid or filed with cement.

The device 300 includes a check valve 306 and a controlled valve 324. The check valve 306 is located within the inner orifice 304 closer to the top end 318 and the controlled valve 324 is located within the inner orifice 304 closer to the bottom end 318. In some embodiments, the check valve 306 is configured to permit flow from the bottom end 316 towards of top end 318 and block flow in the opposite direction. When the casing string 110 and the device 300 are lowered into the wellbore, any initial fluid in the wellbore can flow through the check valve 306. The check valve 306 may be any type of unidirectional valve such as a flapper valve, a ball valve, a swing check valve, a tilting disc check valve, among others.

The check valve 306 illustrated in FIG. 3 is a flapper valve that includes a base 326*a* and a flapper 328*a*. The base 326*a* has an opening formed therethrough which provides a flow path. The flapper 328*a* may be hingedly or flexibly coupled to the base 326*a* such that the flapper 328*a* covers the opening when close. In some embodiment, the flapper 328*a* is allowed to move freely and generally covers the opening 328*a* unless pushed open by a force applied from the bottom end 316 towards the top end 318 such as that caused by a flow of a fluid.

In some embodiments, the controlled valve 324 may also be a flapper valve and include a base 326*b* and a flapper 328*b*. However, opening and closing of the flapper 328*b* is controlled by a control device. The control device may include a motor 310 in conjunction with a processor/microcontroller 312. Specifically, the motor 310 may be a linear motor configured to pull the flapper 328*b* open via a wire 330 or string to permit flow therethrough and unwind the wire 330 or string to allow the flapper 328*b* to close. The motor 310 may be controlled by the processor/microcontroller 312 to open or close the flapper 328*b*. In some embodiments, closing of the flapper 328*b* may be assisted by a spring force or hydraulic force when the flapper 328*b* is released by the motor 310.

The controlled valve 324 may be any kind of valve or mechanism which can be controlled electrically to permit or block flow through the inner orifice 304, including flapper valve, ball valve, butterfly valve, among others.

The sealing device 300 further includes a density meter 308 configured to sense the density of a fluid inside the inner orifice 304 or outside of the sealing device 300. The density meter 308 may be located anywhere in or around the device 300 and is communicatively coupled to the processor/microcontroller 312. The processor/microcontroller 312 is configured to continuously receive a signal from the density meter 308 indicative of the sensed density. The processor/microcontroller 312 or the density meter 308 is configured to detect the occurrence of a certain density condition of the fluid. The certain density condition may be a change is the measured density of the fluid or the measured density of the fluid coming into a certain range or passing a certain threshold, all of which may indicate the presence of the cement, at which point pumping of cement may be stopped.

Upon detecting the density condition, the processor/microcontroller 312 actuates the motor 310, or other mechanical actuator, to close the controlled valve 324, thereby blocking the flow of cement further into the casing string 110. In some embodiments, the motor 310 is absent and actuation mechanisms are built into the controlled valve 324. In such embodiments, the processor/microcontroller 312 directly transmits an actuation signal to the controlled valve 324. The inclusion of both the check valve 306 with the controlled valve 324 can provide a level of redundancy as the check valve 306 prevents fluids from flowing back into the sealing device 128 which may otherwise push the controlled valve 324 ajar.

Figure 4:
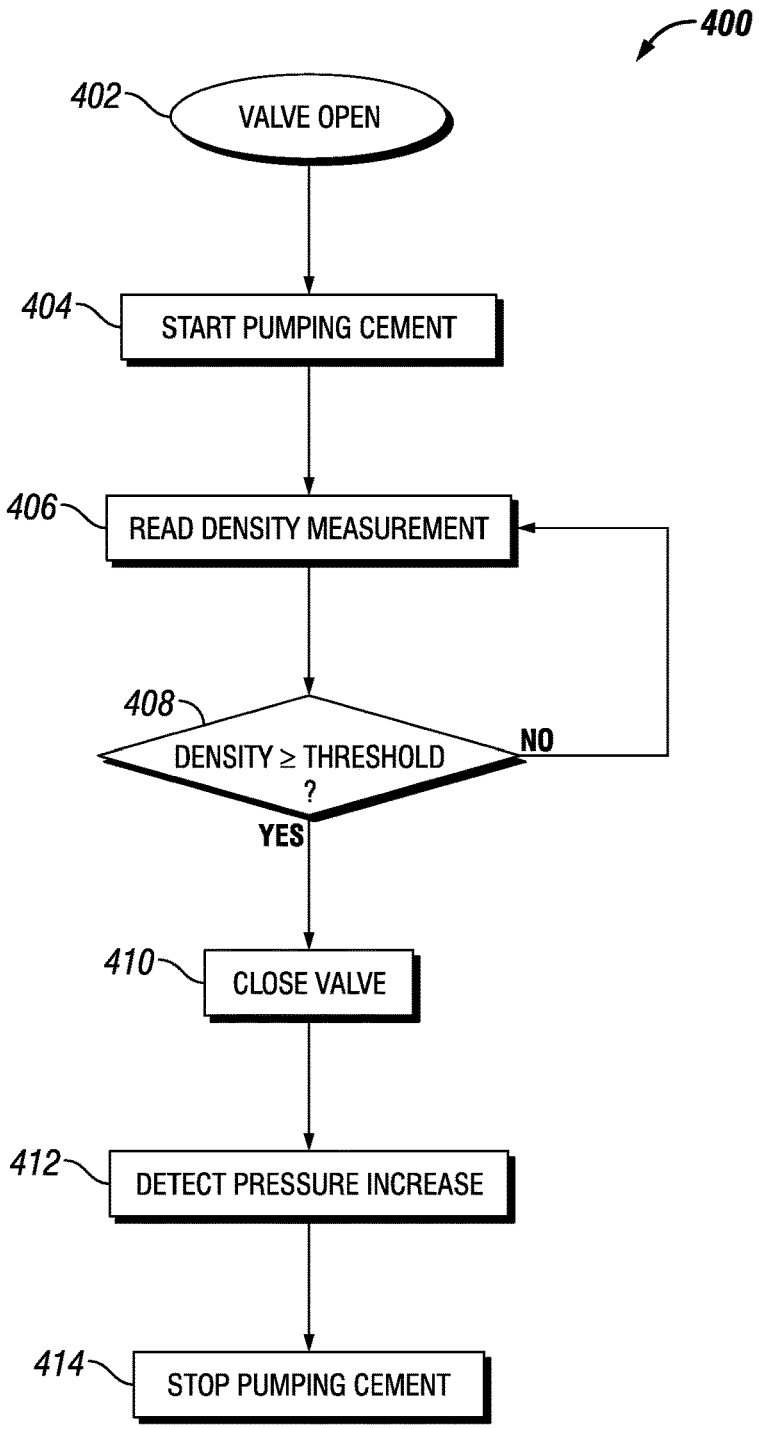
FIG. 4 is a flowchart of a reverse cementing process.

The example material detection and sealing devices 128, 300 of FIGS. 2 and 3 can be used in reverse cementing operations. FIG. 4 is a flowchart illustrating a method 400 of performing a reverse cementing operation. Referring to FIGS. 2 and 4, the method 400 begins with the material detection and sealing device 128 being open (step 402). The sealing device 128 may be installed downhole inside of a casing string, typically towards the distal end of the casing string, but not necessarily so. The method includes then starting to pump cementing fluid downhole (step 404). Cementing fluid continues to be pumped until stopped at step 412. While the cementing fluid is being pumped downhole, the density meter 206 located on the sealing device 128 continuously senses the density of a fluid (406). The processor 220 receives data from the density meter 206 and continuously compares the density data to a threshold (step 408).

If the sensed density of the fluid is less than the threshold, then the density meter 206 keeps making density measurements (step 406) and the processor keeps checking the measurement data against the threshold (step 408); no other action is taken and cement pumping continues. However, if the sensed density of the fluid is equal to or surpasses the threshold, the valve 204 inside the sealing device 128 is closed (410).

Closing the valve 204 closes the casing string 110 to the annulus, blocking any more cementing material from entering the casing string 110. It should be noted that comparing the density measurement to a threshold is one example means of detecting presence of cement. The processor 220 may also detect for a drop or rise in density value or based on any similar other data processing or operating rules. Closing of the valve 204 causes an increase in back pressure which is detecting by the pump 116 (FIG. 1) (step 412). The pressure spike indicates to stop pumping cement downhole. Thus, pumping is stopped (step 414).

Both the sealing device 128 and the surface pump 116 can be configured and preprogrammed to carry out the steps of method 400 autonomously and without human intervention. Thus, the surface pump 116 and the sealing device 128 may communicate wirelessly. Indication to stop pumping can be communicated from the sealing device 128 to the surface pump 116 through the pressure spike when the valve 204 is closed, which is detectable by the pump 116. The pressure spike also indicates that the casing string 110 has been properly sealed by the sealing device 128. In some embodiments, the surface pump 116 and the device 128 may communicate through wired or wireless communication.

In addition to the embodiments described above, many examples of specific combinations are within the scope of the disclosure, some of which are detailed below:

Example 1

A material detection and sealing device, comprising:

a body configured to fit within a casing string;

a valve located within the body configured to open and close an orifice formed through the body;

a density meter configured to sense the density of a fluid; and wherein the valve is configured to close upon the density meter sensing a certain density condition of the fluid.

Example 2

The device of example 1, wherein the valve comprises a flapper valve, a ball valve, a check valve, a controlled valve, or any combination thereof.

Example 3

The device of example 1, comprising a unidirectional valve located within the body and configured to permit flow of fluid through the body only in one direction.

Example 4

The device of example 1, wherein the density condition comprises a change in the sensed density of the fluid or the sensed density being within a value range or past a threshold value.

Example 5

The device of example 1, wherein the fluid is located within the orifice.

Example 6

The device of example 1, further comprising a microcontroller configured to receive density data from the density meter and send an electrical signal to close the valve upon the density data meeting the density condition.

Example 7

The device of example 1, wherein the density meter configured to continuously sense the density of the fluid.

Example 8

A cementing system for cementing casing in a wellbore, comprising:

a casing string located in the wellbore, an annulus being formed between the casing string and the wellbore;

a pump configured to pump a cementing material into the annulus space; and a sealing device located within the casing string, comprising:

a valve configured to permit flow into the casing string from the annulus in an open state and block flow into the casing string in a closed state;

a density meter configured to sense the density of a fluid; and wherein the valve is configured to close upon the density meter sensing a certain density condition of the fluid.

Example 9

The system of example 8, wherein the fluid is located in the inside of the casing string or in the annulus.

Example 10

The system of example 8, wherein the sealing device comprises a body configured to seal against the inside of the casing string, wherein the body comprises an orifice formed therein which permits flow into the casing string, and wherein opening and closing of the orifice is controlled by the valve.

Example 11

The system of example 10, wherein the pump is configured to stop pumping the cementing material upon detecting a rise in back pressure.

Example 12

The system of example 8, wherein the valve comprises one or more of a flapper valve, a ball valve, a check valve, a controlled valve, or any combination thereof.

Example 13

The system of example 8, wherein the density condition comprises a change in the sensed density of the fluid or the sensed density of the fluid being within a value range or pass a threshold valve.

Example 14

The system of example 8, wherein the sealing device further comprises a microcontroller configured to receive density data from the density meter and send an electrical signal to close the valve upon the density data meeting the density condition.

Example 15

The system of example 8, wherein the sealing device is located at a distal end of the casing string.

Example 16

A method of cementing a wellbore, comprising:

pumping a cementing material into an annular space between a casing string and the wellbore;

detecting the presence of the cementing material at a location along the casing string;

closing a valve within the casing string upon the detection of the cementing material; and stopping pumping of the cementing material after closing the valve.

Example 17

The method of example 16, further comprising detecting a rise in back pressure at the pump upon closing the valve, and stopping pumping of the cementing material upon detecting the rise in back pressure.

Example 18

The method of example 16, wherein detecting the presence of the cementing material comprises detecting a certain density condition in a fluid, wherein the fluid is located in the annular space, inside the casing string, or at well bottom.

Example 19

The method of example 16, wherein closing the valve further comprises preventing the cementing material from flowing further into the inside of the casing.

Example 20

The method of example 16, comprising allowing the cementing material to harden.

This discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A material detection and sealing device for a casing string in a well, the material detecting and sealing device comprising:

a body configured to fit within the casing string;

a valve located within the body and configured to open and close an orifice through the body;

a density meter coupled to the body and configured to sense the density of a fluid flowed through the orifice;

a microcontroller coupled to the body and in electronic communication with the valve and the density meter, the microcontroller configured to receive density data from the density meter and send an electrical signal to close the valve upon the density data meeting the density condition;

wherein the valve is configured to close upon the density meter sensing a certain density condition of the fluid; and wherein the valve, the density meter, and the microcontroller are only in electronic communication with each other.

2. The device of claim 1, wherein the valve comprises a flapper valve, a ball valve, a check valve, a controlled valve, or any combination thereof.

3. The device of claim 1, comprising a unidirectional valve located within the body and configured to permit flow of fluid through the body only in one direction.

4. The device of claim 1, wherein the density condition comprises a change in the sensed density of the fluid or the sensed density being within a value range or past a threshold value.

5. The device of claim 1, wherein the fluid is located within the orifice.

6. The device of claim 1, wherein the density meter configured to continuously sense the density of the fluid.

7. A cementing system for cementing casing in a wellbore, comprising:

a casing string located in the wellbore, an annulus being formed between the casing string and the wellbore;

a pump configured to pump a cementing material into the annulus space; and a sealing device located within the casing string, the sealing device comprising:

a body positioned within the casing string;

a valve located within the both and configured to permit flow into the casing string from the annulus in an open state and block flow into the casing string in a closed state;

a density meter coupled to the body and configured to sense the density of a fluid;

a microcontroller coupled to the body and in electronic communication with the valve and the density meter, the microcontroller configured to receive density data from the density meter and send an electrical signal to close the valve upon the density data meeting the density condition;

wherein the valve is configured to close upon the density meter sensing a certain density condition of the fluid; and wherein the sealing device is not in communication with the surface.

8. The system of claim 7, wherein the fluid is located in the inside of the casing string or in the annulus.

9. The system of claim 7, wherein the sealing device comprises a body configured to seal against the inside of the casing string, wherein the body comprises an orifice formed therein which permits flow into the casing string, and wherein opening and closing of the orifice is controlled by the valve.

10. The system of claim 9, wherein the pump is configured to stop pumping the cementing material upon detecting a rise in back pressure.

11. The system of claim 7, wherein the valve comprises one or more of a flapper valve, a ball valve, a check valve, a controlled valve, or any combination thereof.

12. The system of claim 7, wherein the density condition comprises a change in the sensed density of the fluid or the sensed density of the fluid being within a value range or pass a threshold valve.

13. The system of claim 7, wherein the sealing device is located at a distal end of the casing string.

14. A method of cementing a wellbore, comprising:

pumping a cementing material into an annular space between a casing string and the wellbore;

detecting the presence of the cementing material at a location along the casing string with a material detection and sealing device, wherein the material detection and sealing device is not in communication with the surface;

closing a valve of the material detection and sealing device within the casing string upon the detection of the cementing material; and stopping pumping of the cementing material after closing the valve.

15. The method of claim 14, further comprising detecting a rise in back pressure at the pump upon closing the valve, and stopping pumping of the cementing material upon detecting the rise in back pressure.

16. The method of claim 14, wherein detecting the presence of the cementing material comprises detecting a certain density condition in a fluid, wherein the fluid is located in the annular space, inside the casing string, or at well bottom.

17. The method of claim 14, wherein closing the valve further comprises preventing the cementing material from flowing further into the inside of the casing.

18. The method of claim 14, comprising allowing the cementing material to harden.

* * * * *